US007896669B2

(12) United States Patent
Ting

(10) Patent No.: US 7,896,669 B2
(45) Date of Patent: Mar. 1, 2011

(54) ELECTRICAL CARD CONNECTOR

(75) Inventor: Chien-Jen Ting, Tu-cheng (TW)

(73) Assignee: Hon Hai Precision Ind. Co., Ltd., New Taipei (TW)

( * ) Notice: Subject to any disclaimer, the term of this patent is extended or adjusted under 35 U.S.C. 154(b) by 0 days.

(21) Appl. No.: 12/290,091

(22) Filed: Oct. 27, 2008

(65) Prior Publication Data

US 2009/0111329 A1 Apr. 30, 2009

(30) Foreign Application Priority Data

Oct. 26, 2007 (TW) ..... 96140343 A

(51) Int. Cl.
*H01R 13/62* (2006.01)

(52) U.S. Cl. ..... 439/159; 439/630

(58) Field of Classification Search ..... 439/159, 439/630

See application file for complete search history.

(56) References Cited

U.S. PATENT DOCUMENTS 7,033,223 B1 * 4/2006 Lin ..... 439/630
7,052,295 B1 * 5/2006 Lin ..... 439/159
7,226,318 B1 * 6/2007 Lee ..... 439/630
2002/0160661 A1 * 10/2002 Florescu ..... 439/630
2003/0119364 A1 * 6/2003 Liu ..... 439/630
2003/0157842 A1 * 8/2003 Arnett et al. ..... 439/676
2004/0087194 A1 * 5/2004 Wang et al. ..... 439/159
2005/0037667 A1 * 2/2005 Yu ..... 439/630
2005/0112947 A1 * 5/2005 Fan ..... 439/630
2006/0223376 A1 * 10/2006 Chang et al. ..... 439/630
2006/0223377 A1 * 10/2006 Chang et al. ..... 439/630
2007/0105447 A1 * 5/2007 Tsai ..... 439/630
2007/0207676 A1 * 9/2007 Ying et al. ..... 439/630
2007/0287312 A1 * 12/2007 Yu et al. ..... 439/160
2008/0119071 A1 5/2008 Ting et al.

* cited by examiner

*Primary Examiner* — Briggitte R Hammond
*Assistant Examiner* — Larisa Z Tsukerman
(74) *Attorney, Agent, or Firm* — Wei Te Chung; Andrew C. Cheng; Ming Chieh Chang

(57) ABSTRACT

An electrical card connector (100) includes an insulating housing (2), a metal shield (1) covering the insulating housing for defining a card receiving space therebetween, a printed circuit board (PCB) (5), an insulator (3) assembled on the PCB and a plurality of terminals (4) received in the insulator. The insulating housing defines a cutout (210) at a rear part thereof and the cutout communicates with the card receiving space. The PCB has a smaller size than the insulating housing and is received in the cutout. The PCB is fused with the insulating housing.

7 Claims, 4 Drawing Sheets

ELECTRICAL CARD CONNECTOR

BACKGROUND OF THE INVENTION

1. Field of the Invention

The present invention relates generally to electrical card connectors, and more particularly to an electrical card connector assembled on a printed circuit board (PCB) for electrically connected with other electrical devices.

2. Description of Related Arts

With a rapid development of the electronic technology, electrical products, such as Personal Digital Assistants (PDA), Digital Still Cameras (DSC) or etc, are more and more minimized and meanwhile, the other way, are urgent of larger storage for meeting with customer's multiple and variety requirements. Memory cards, storing message and then transferring information between the electrical product and another one, are invented. Memory cards may be express cards, card buses, smart cards or etc adapted for different electrical card connectors.

An electrical card connector is always electrically connected with a PCB for electrically connected with other electrical devices. Usually, the electrical card connector comprises an insulating housing, a plurality of terminals received in the insulating housing and a metal shield covering the insulating housing. The metal shield forms a plurality of locking portions at two lateral sides and the PCB defines a plurality of matable elements mating with the locking portions for associating the electrical card connector with the PCB. The terminals comprise soldering portions electrically connected with soldering pads of the PCB. The PCB has a large size and the soldering pads connected with the soldering portions of the terminals only take a little room of the PCB, a large space of the PCB is unavailable and of course, it causes a waste of material.

Hence, an improved electrical card connector, which can avoid a waste of material, is desired.

SUMMARY OF THE INVENTION

Accordingly, an object of the present invention is to provide an electrical card connector, which can avoid a waste of material.

To achieve the above object, an electrical card connector includes an insulating housing, a metal shield covering the insulating housing for defining a card receiving space therebetween, a printed circuit board (PCB), an insulator assembled on the PCB and a plurality of terminals received in the insulator. The insulating housing defines a cutout at a rear part thereof and the cutout communicates with the card receiving space. The PCB has a smaller size than the insulating housing and is received in the cutout. The PCB is fused with the insulating housing.

Other objects, advantages and novel features of the invention will become more apparent from the following detailed description when taken in conjunction with the accompanying drawings.

DETAILED DESCRIPTION OF THE PREFERRED EMBODIMENT

Figure 1:
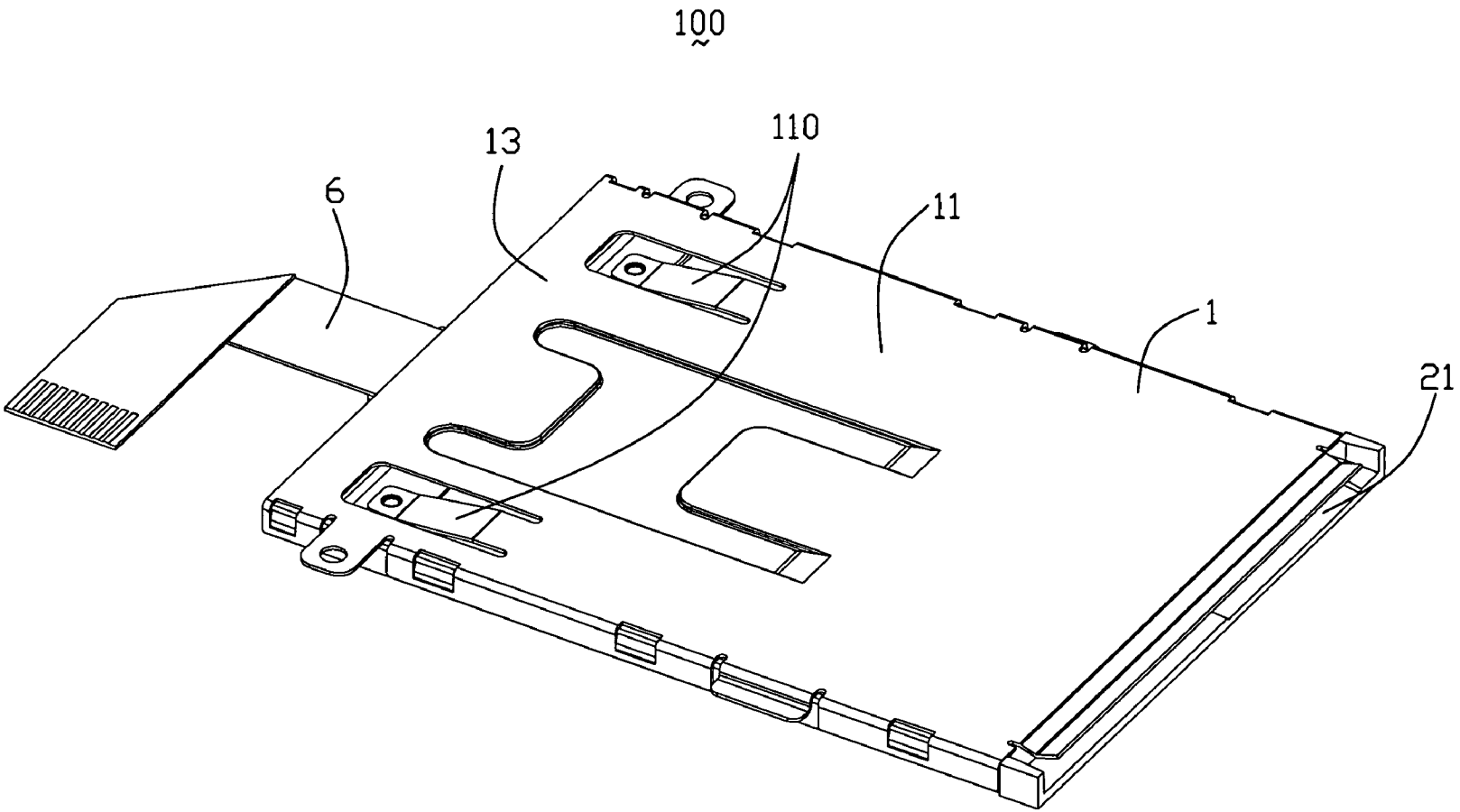
FIG. 1 is a perspective, assembled view of an electrical card connector according to the present invention.

FIGS. 1-4 illustrate an electrical card connector 100 in accordance with the present invention comprising a metal shield 1, an insulating housing 2 covered by the metal shield 1, an insulator 3, a plurality of terminals 4 received in the insulator 3, a PCB 5 electrically connected with the terminals 4 and a flexible circuit board 6 connected with the PCB 5. The insulator 3 and the terminals 4 are cooperatively combined in a terminal module (not labeled).

Figure 2:
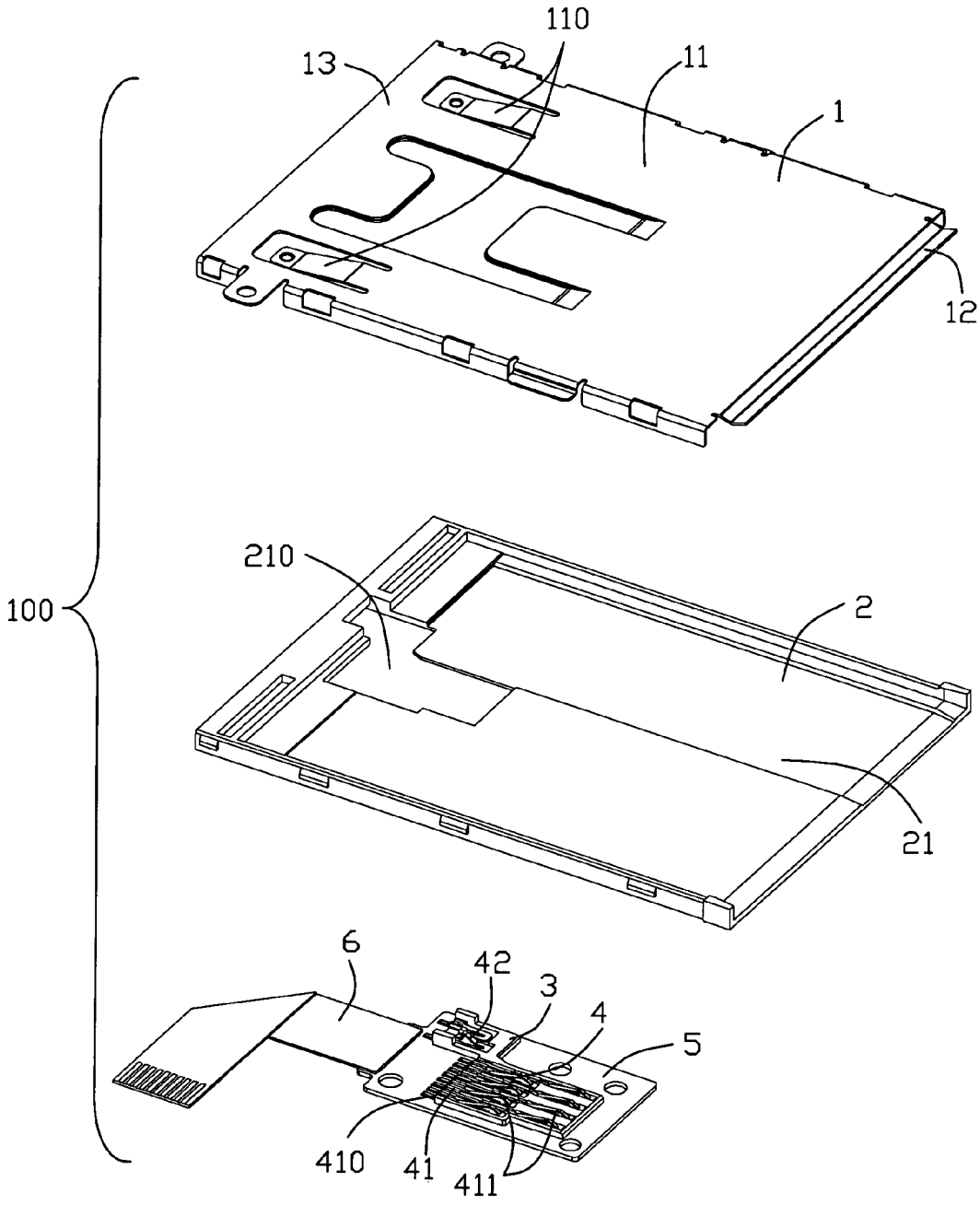
FIG. 2 is a perspective, exploded view of the electrical card connector.

Referring to FIGS. 1 and 2, the metal shield 1 sheaths over the insulating housing 2 for defining a card receiving space 21. The metal shield 1 forms a generally rectangular flat portion 11, which defines a front end 12 for an electrical card inserted therethrough and a rear end 13 opposite to the front end 12. The flat portion 11 forms a pair of elastic pieces 110 close to the rear end 13 and extending into the card receiving space 21.

Figure 3:
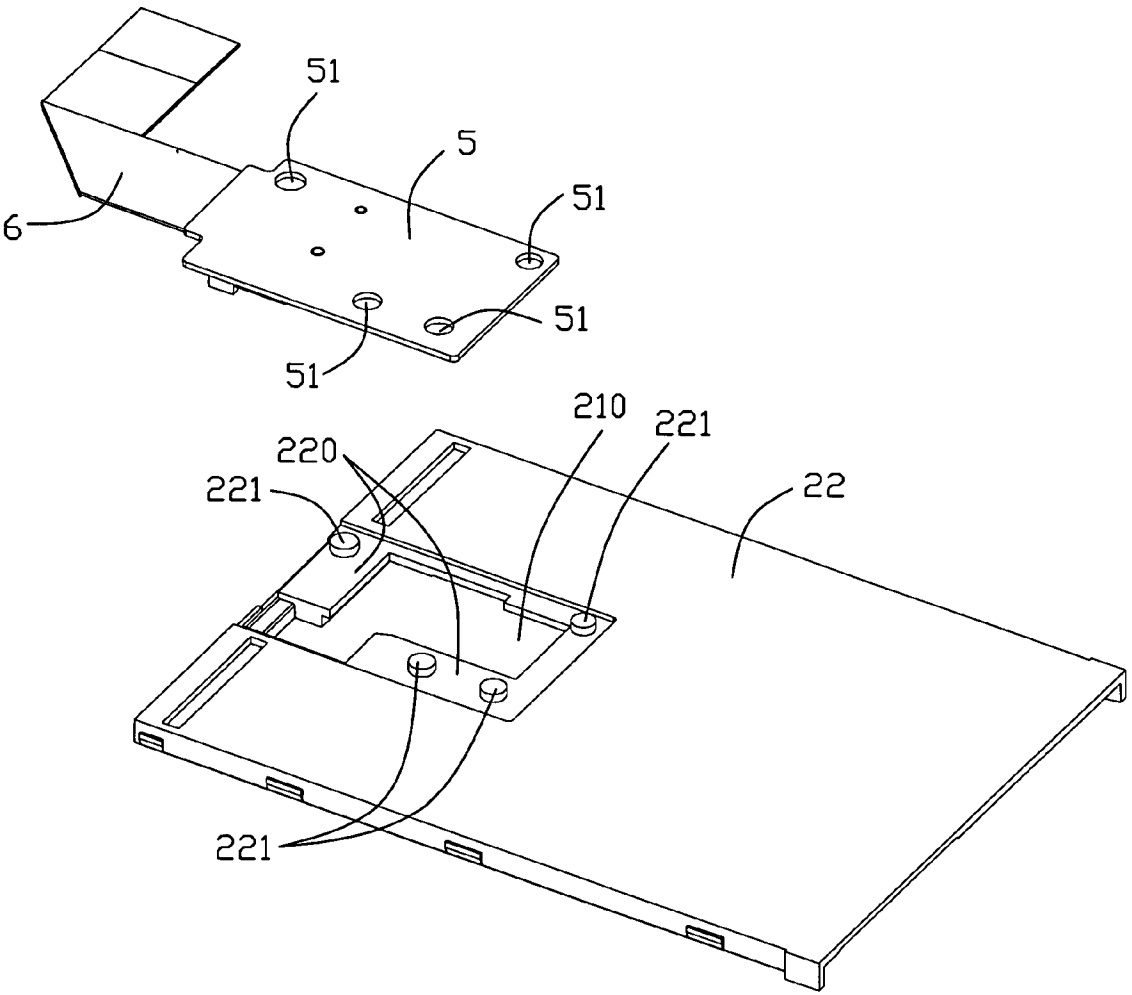
FIG. 3 is a perspective, partly assembled view of the electrical card connector taken from a different aspect with respect to FIG. 2.

Referring to FIGS. 2 and 3, the insulating housing 2 comprises a bottom face 22 and the bottom face 22 defines a cutout 210 at a rear part thereof and the cutout 210 communicates with the card receiving space 21. The cutout 210 forms a plurality of supporting portions 220 around. The supporting portions 220 are stepped along the bottom face 22 and the supporting portions 220 form a lot of columns 221 dispersed around the cutout 210 and extending towards the bottom face 22.

Referring to FIGS. 2 and 3, the terminals 4 are divided into a first terminal array 41 and a second terminal array 42 located at a rear part and meanwhile a lateral side of the first terminal array 41. The first terminal array 41 forms a plurality of soldering portions 410, a plurality of contacting portions 411 and connecting portions (not labeled) jointing the soldering portions 410 with the contacting portions 411. The soldering portions 410 extend out of a rear end of the insulator 3 and are arranged along a line. The contacting portions 411 extend beyond an upper surface of the insulator 3 and are arranged in two parallel lines. The second terminal array 42 acts as a switch terminal array comprising a moveable terminal (not labeled) having a flexible portion (not labeled) and an immovable terminal (not labeled) having a matched portion (not labeled), while the flexible portion of the moveable terminal is located above the matched portion of the immovable terminal. The insulator 3 is attached to the PCB 5. The soldering portions 410 of the first terminal array 41 and soldering portions (not labeled) of the second terminal array 42 are both soldered with circuit pads of the PCB 5. The PCB 5 defines a plurality of apertures 51, which are dispersed around the insulator 3. The flexible circuit board 6 is electrically connected with the PCB 5.

Figure 4:
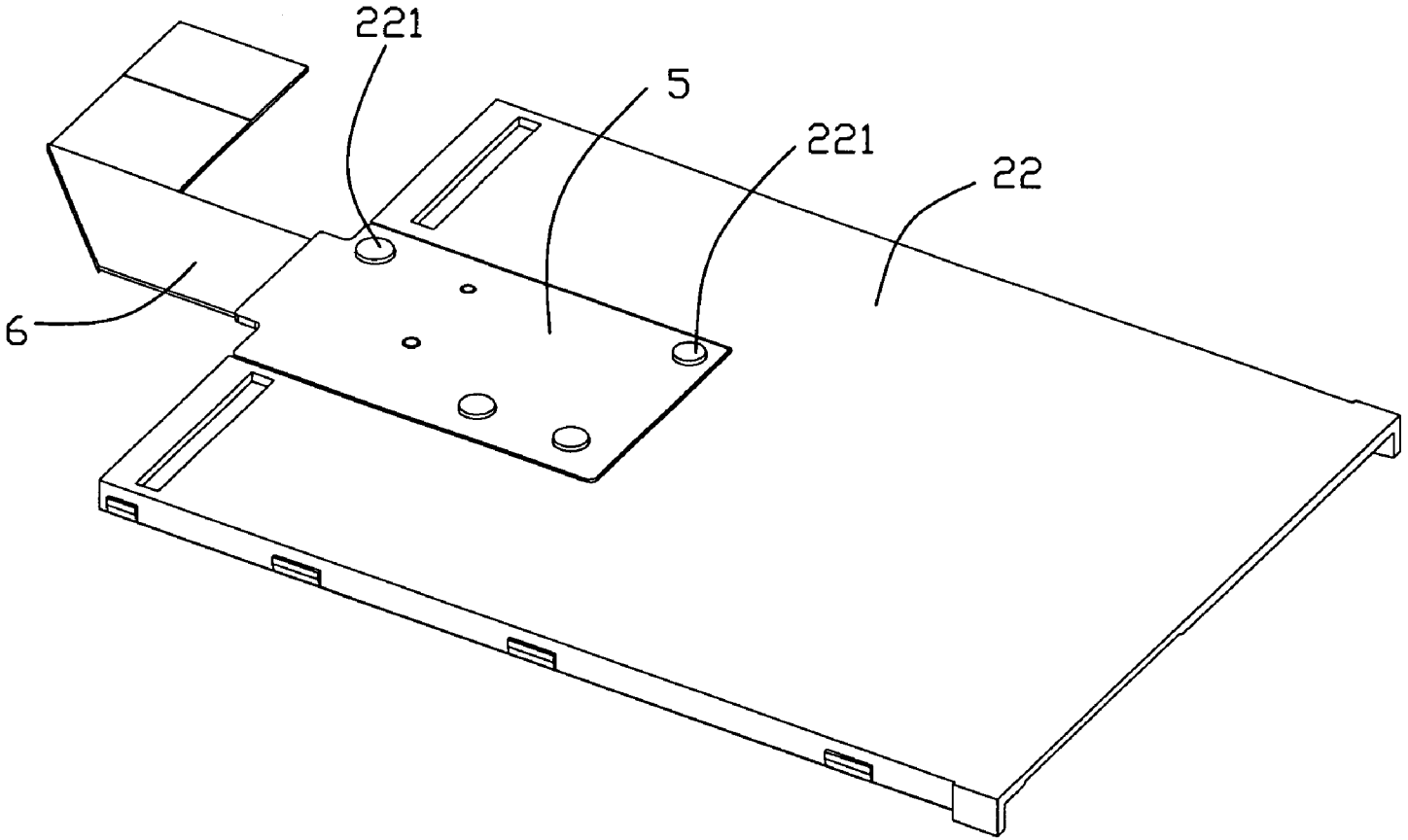
FIG. 4 is a perspective, assembled view of the electrical card connector similar to FIG. 3.

Referring to FIGS. 3-4, the PCB 5 with the insulator 3 and the flexible circuit board 6 assembled thereon, is assembled on to the insulating housing 2 from a side of the bottom face 22: the PCB 5 is received in the cutout 210 and is supported by the supporting portions 220. The columns 221 are correspondingly received in the apertures 51 of the PCB 5 and then the columns 221 and the apertures 51 are fused under a high temperature to achieve a fixed attachment between the PCB 5 and the insulating housing 2. The contacting portions 411 of the first terminal array 41 and the contacting portions (not labeled) of the second terminal array 42 both extend into the card receiving space 21 through the cutout 210. When the electrical card is inserted, the electrical connection will not be attained until a front edge of the electrical card achieves at the flexible portion of the movable terminal and presses against the flexible portion to make a contact between the flexible portion and the matched portion.

Because the PCB 5 has a smaller size suitable to be received in the cutout 210, a fixed attachment between the PCB 5 and the insulating housing 2 is achieved after a fusion under a high temperature. In this invention, it reduces a cost of the PCB 5 to enhance a predominance of the product. The columns 221 and the corresponding apertures 51 are dispersed around the insulator 3 to avoid a wrap of the PCB 5, and an excellent electrical connection is achieved between the electrical card and the electrical card connector 100 thereby.

While a preferred embodiment in accordance with the present invention has been shown and described, equivalent modifications and changes known to persons skilled in the art according to the spirit of the present invention are considered within the scope of the present invention as described in the appended claims.

I claim:

1. An electrical card connector comprising:

an insulative housing and a metallic shell commonly defining a rectangular card receiving space therebetween;

a through opening defined in the housing to communicate with the card receiving space; and a printed circuit board attached to the housing and covering said through opening, with a bottom surface of the PCB coplanar with a bottom face of the insulative housing; wherein a flexible printed circuit is connected to an edge of the printed circuit board and extends outward therefrom, and a terminal module is assembled upon the printed circuit board to have terminals of said terminal module extend into the card receiving space.

2. The electrical card connector as described in claim 1, wherein the opening forms a plurality of supporting portions stepped along a bottom face of the insulating housing.

3. The electrical card connector as described in claim 2, wherein the supporting portions form a plurality of columns dispersed around the opening and the PCB defines a plurality of apertures receiving the columns.

4. The electrical card connector as claimed in claim 1, wherein said through opening is dimensioned similar to a size of the terminal module for compliantly receiving said terminal module therein.

5. The electrical card connector as described in claim 1, wherein an upper surface of the insulator keeps planar with an upper face of the insulative housing.

6. The electrical card connector as described in claim 5, the terminals extend beyond an upper surface of the insulator into the card receiving space.

7. An electrical card connector comprising:

an insulative housing and a metallic shell commonly defining a rectangular card receiving space therebetween;

a through opening defined in the housing to communicate with the card receiving space; and a printed circuit board attached to the housing and covering said through opening; wherein a flexible printed circuit is connected to an edge of the printed circuit board and extends outward therefrom, and a terminal module is assembled upon the printed circuit board to have terminals of said terminal module extend into the card receiving space; wherein in a top view, the printed circuit board is slightly larger than the through opening but is smaller than the housing, and the printed circuit board is located within a contour of the housing; wherein said through opening is dimensioned similar to a size of the terminal module for compliantly receiving said terminal module therein.

* * * * *